United States Patent [19]

Teeter

[11] Patent Number: 4,555,726

[45] Date of Patent: Nov. 26, 1985

[54] VIDEO TARGET TRACK VALID INDICATOR

[75] Inventor: Brent A. Teeter, Ridgecrest, Calif.

[73] Assignee: The United States of America as represented by the Secretary of the Navy, Washington, D.C.

[21] Appl. No.: 586,366

[22] Filed: Mar. 5, 1984

[51] Int. Cl.[4] ..... H04N 7/18

[52] U.S. Cl. ..... 358/93; 358/103; 358/107; 358/108; 358/138; 358/125; 358/126

[58] Field of Search ..... 358/93, 106, 107, 108, 358/103, 126, 138, 125

[56] References Cited

U.S. PATENT DOCUMENTS

| | | | |
|---|---|---|---|
| 3,829,614 | 8/1974 | Ahlbom et al. | 358/126 |
| 3,988,534 | 10/1976 | Sacks | 358/126 |
| 4,115,804 | 9/1978 | Morton et al. | 358/107 |
| 4,196,447 | 4/1980 | Dalke | 358/82 |
| 4,334,241 | 6/1982 | Kashioka et al. | 358/107 |
| 4,349,838 | 9/1982 | Daniel | 358/125 |
| 4,386,848 | 6/1983 | Clendenin | 358/125 |
| 4,443,855 | 4/1984 | Bishop | 358/107 |

*Primary Examiner*—Howard W. Britton

*Attorney, Agent, or Firm*—Robert F. Beers; W. Thom Skeer; William J. Beres

[57] ABSTRACT

Video signal monitoring apparatus searches a video signal for the existence of an imposed indicator signal having predetermined characteristics. The indicator signal is a series of pulses exceeding a predetermined brightness level and having a duration falling within a predetermined range of durations imposed one pulse per video line in a predetermined number of consecutive video lines in a video frame. A stripper circuit extracts signals indicative of the start of each video line and each video frame as well as pulses in each video line having a brightness level exceeding the predetermined brightness level which indicator pulses must exceed from the video signal as the video signal is received. The duration of each pulse extracted from a video line is determined and a counter is incremented for each line in which a pulse is found to exist having a duration falling within the range of durations established for indicator pulses. If the counter is incremented a predetermined number of times equal to the number of consecutive lines in which indicator pulses are imposed to constitute an indicator signal, without being cleared, an indicator found signal is produced for further use in alerting a system user to the existence of a valid indicator signal in the video signal.

7 Claims, 4 Drawing Figures

VIDEO TARGET TRACK VALID INDICATOR

BACKGROUND OF THE INVENTION

1. Field of the Invention

This invention relates to a munition system in which target acquisition or lock-on is indicated by the imposition of an indicator signal having predetermined characteristics onto a weapon produced video signal.

More particularly, this invention relates to apparatus which searches a weapon produced video signal for the existence of a distinct target lock-on indicator signal, validates that signal when found and produces an indicator found signal for communicating the existence of a validated video indicator to the munition system user.

2. Description of the Prior Art

In many current munition systems the weapon associated with the system produces a video signal utilized by the weapon user for target acquisition and weapon employment purposes. The video signal produced by the weapon is indicative of what the weapon "sees" or senses within its field of view. The weapon produced video signal is transmitted to the weapon carrying platform to aid the weapon user in determining when conditions exist warranting release of the weapon. In a portion of such weapon systems a discrete signal is imposed on the transmitted video signal for the purpose of indicating that the weapon has sensed and locked onto a target.

The nature of the video signal produced by the weapon and transmitted to the weapon carrying platform, the characteristics of the lock-on indicator signal imposed on that video signal as well as the conditions which will satisfy target lock-on criteria will differ from one munition system to the next. The use of a laser beam purposefully aimed at and reflected off of an object to designate that object as a target has come into increasing use. Munitions systems which use laser designation for target acquisition include a sensor for sensing the existence of a target reflected laser light beam when such a beam exists within the area scanned by the weapon's sensor.

The use of a laser for designation purposes lends itself to the production of a two state video signal by a weapon. One video signal state indicates the receipt of laser light emanating from the area within the field of view of the weapon while the second state indicates that no laser light emanates from the area. When laser light impinges on the weapon sensor the weapon produces a lock-on indicator signal and imposes that signal on the video signal transmitted to a video console in the weapon carrying platform. The indicator signal appears on the console in order to visually alert the weapon user to target lock-on conditions.

In the environment in which such munition systems are to be employed, the weapon user is expected to experience many distractions making continuous monitoring, of the video console impossible. As such, a need exists to alert the weapon user to the existence of target lock-on conditions in a manner alternative to the production of an indicator signal on a video console.

The present invention, therefore, is concerned with the detection of a target lock-on indicator of predetermined characteristics in a weapon produced video signal.

SUMMARY OF THE INVENTION

The apparatus of the present invention monitors a weapon produced video signal on which will be imposed a distinct indicator signal when weapon sensor scanning determines the existence of a target in the scanned area. Three components of the weapon produced video signal are extracted and utilized by the apparatus. A stripper circuit extracts vertical sync signals, the assertion of which are indicative of the start of each video frame, horizontal sync signals, the deassertion of which are indicative of the start of each video line, and white pulse signals, having brightness levels meeting minimum brightness criteria established for pulses making up an imposed indicator signal.

A pulse length check circuit determines the duration of each stripped white pulse input to it and produces a pulse found signal in response to receipt of qualified white pulses, qualified pulses being pulses satisfying established pulse duration criteria. When pulse found signals are produced in response to the existence of at least one qualified pulse in each of a consecutive number of video lines in a video frame a finder circuit produces a trigger signal which is communicated to the system controller. The system controller provides timed control signals to the subcircuits of the apparatus and produces an indicator found signal in response to receipt of a trigger signal from the finder circuit. The controller produced indicator signal is provided to an output circuit where it is operated upon and made compatible for external use in alerting the weapon user to the existence of a target.

It is therefore an object of the present invention to monitor a video signal for the existence of an indicator signal having predetermined characteristics.

It is further an object of this invention to monitor a video signal for the existence of indicator signals, to validate such indicator signals when found and to produce an indicator found signal in response to the receipt and validation of indicator signals.

With these observations and objectives in mind, the manner in which the invention achieves its purpose will be discerned from the following description and accompanying drawings which exemplify the invention and which may be modified to achieve the same results without departing from the essentials of the invention as set forth in the appended claims.

DESCRIPTION OF THE PREFERRED EMBODIMENT

Figure 1:
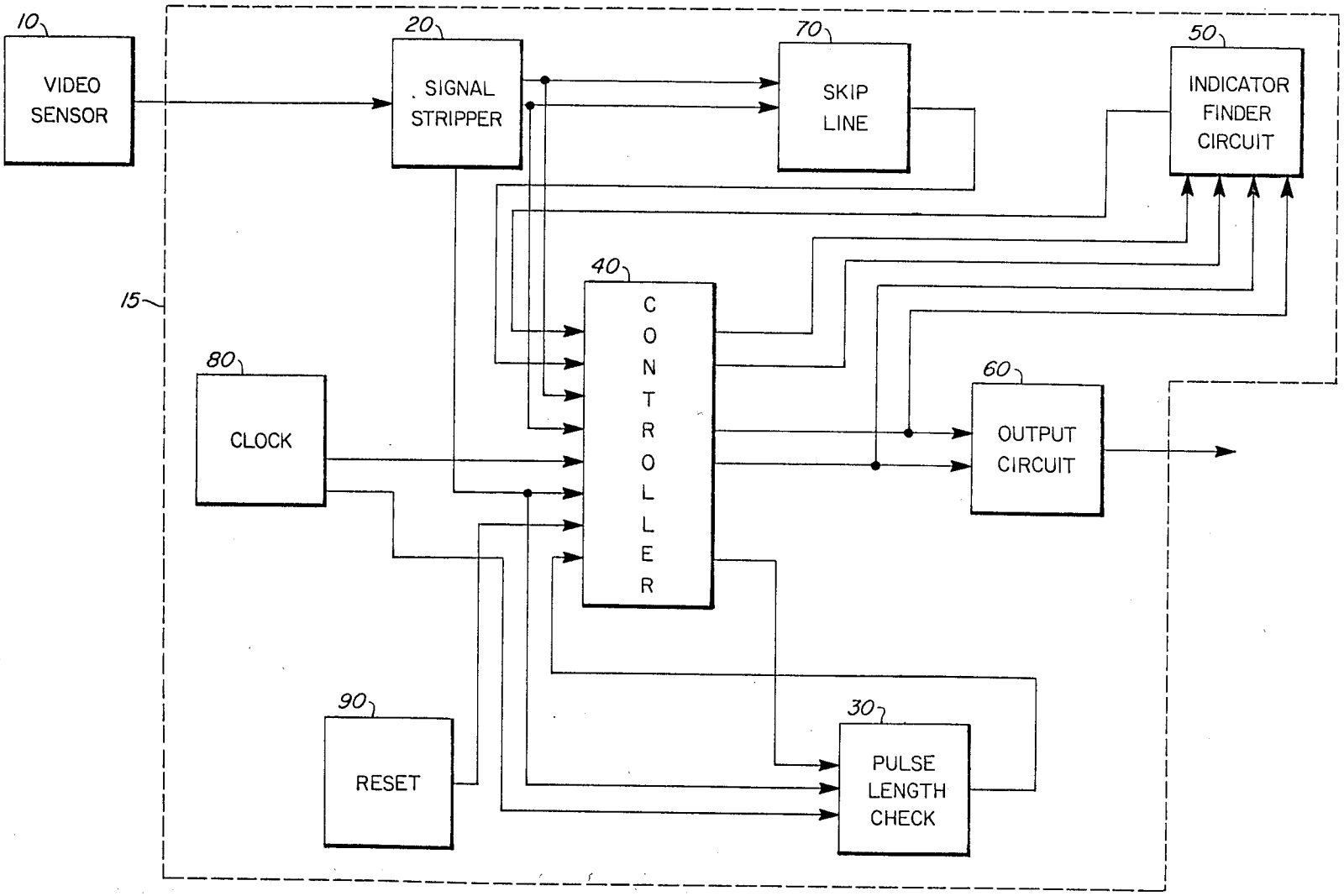
FIG. 1 is a block diagram demonstrating the basic components of the monitoring apparatus.
Figure 2:
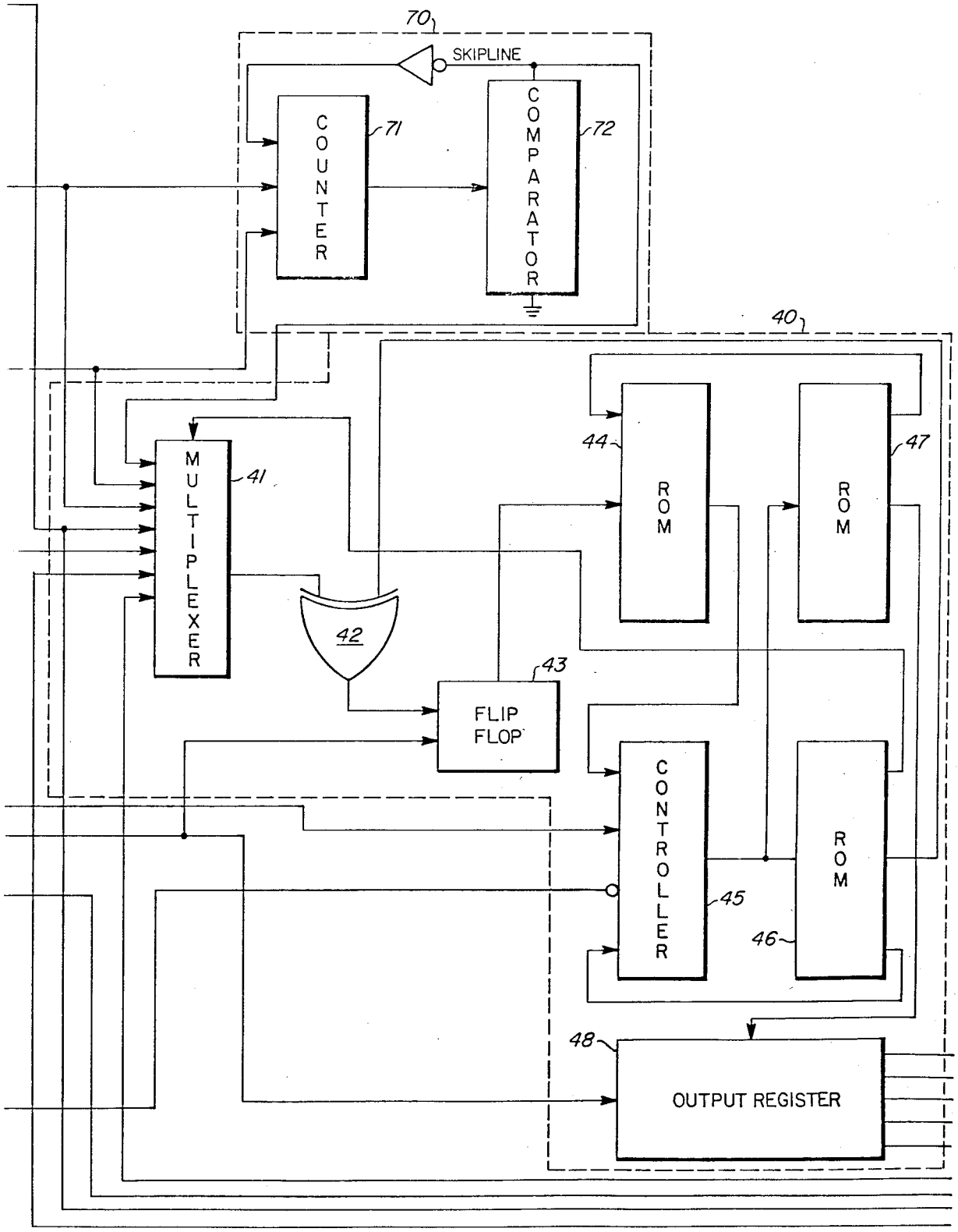
Figure 2:
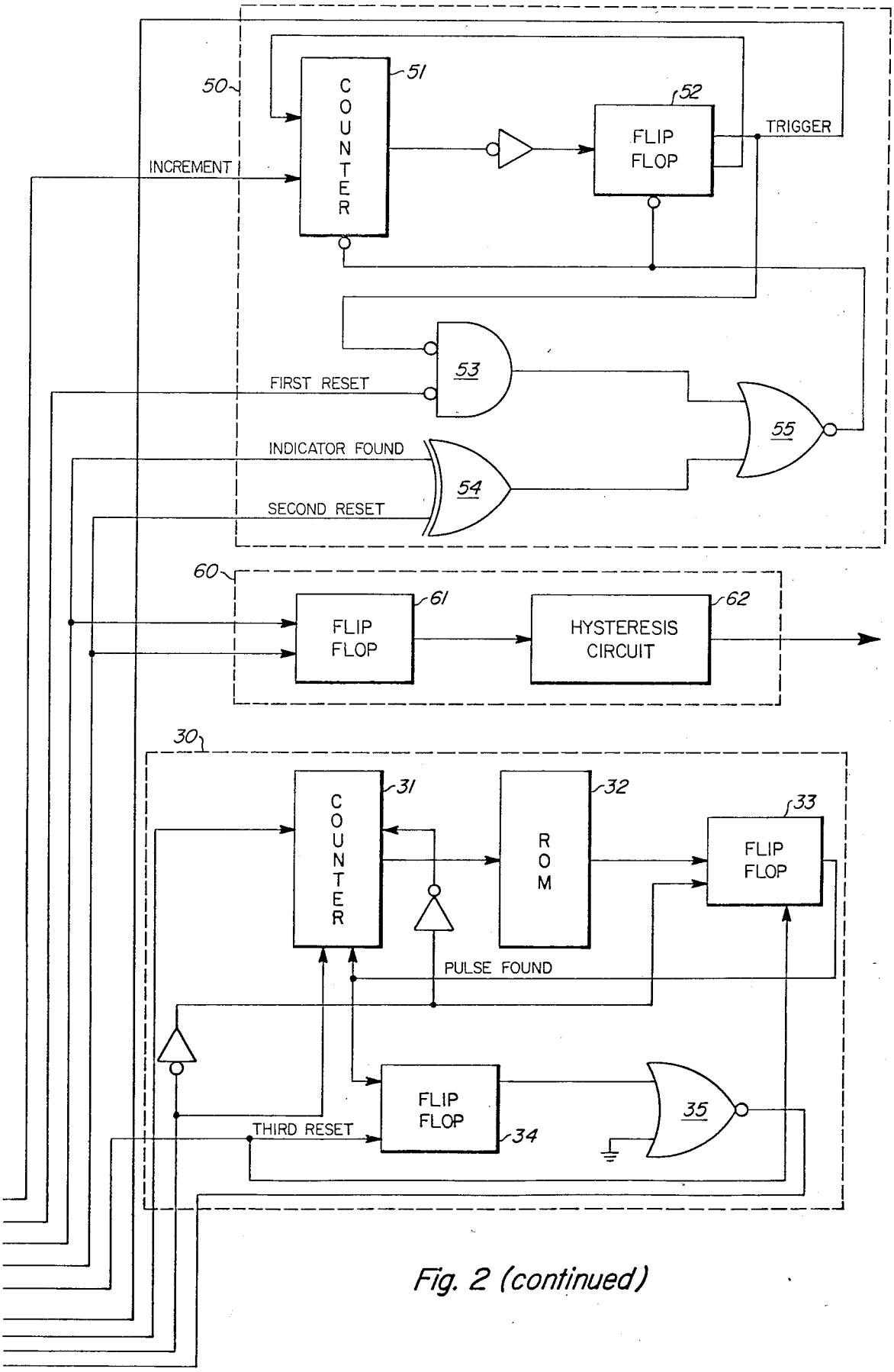

Referring to FIG. 1, a basic block diagram of the apparatus of the present invention is presented. Video sensor 10 is located in a weapon carried by a platform, such as an aircraft, and scans a predetermined area in a raster fashion producing a video signal definitive of what is sensed in the scanned area.

Certain phenomena will be sensed by sensor 10 when such phenomena exist in the scanned area. One such phenomenon is the emanation of laser light having predetermined characteristics from the scanned area. Such laser light may be laser light deliberately aimed at and reflected off of an object to designate that object as a target. In response to the existence and sensing of such phenomena in the scanned area sensor 10 imposes an indicator signal having predetermined characteristics on the video signal it produces. The indicator signal is imposed on the video signal at a point in the raster scan at which the phenomenon is sensed and is indicative of the physical location of the phenomenon in the sensor's field of view. Production of the indicator signal signifies that the weapon has sensed the phenomenon and is tracking it. The indicator signal produced by sensor 10 and imposed on the sensor produced video signal consists of a series of pulses imposed one per video line in a number of consecutive video lines. One video line is produced for each raster sweep of sensor 10. The pulses imposed on the video signal which constitute an indicator signal each have a brightness level exceeding a predetermined minimum brightness level and a duration falling within a predetermined range of durations.

Sensor 10 transmits its video signal to the weapon carrying platform where the signal is utilized to produce an image on a screen monitored by the weapon user. The video image produced on the platform screen will include the imposed signal when qualifying phenomena exists in the scanned area. The indicator signal will appear on the screen in a location relative to the location of the phenomenon in the scanned area and is provided to alert the weapon user to the existence of the phenomenon as well as to the fact that the phenomenon is sensed by the weapon.

It has been found desirable to extract imposed indicator signals from the weapon produced video signal and to utilize the extracted signals to alert the weapon user, in alternative ways, of the existence of phenomena which excites the weapon sensor to produce an indicator signal. Consequently the video signal produced by sensor 10 is input to monitoring apparatus 15.

The weapon sensor produced video signal is input to signal stripper 20 where three components of the signal are extracted. These three components are horizontal sync signals, vertical sync signals and white pulses occurring in the video signal. White pulses extracted are those having a brightness level exceeding the predetermined minimum brightness level established for pulses which are imposed on the video signal to constitute an indicator signal. Horizontal sync signals separate video lines within a video frame. Assertion of a horizontal sync signal represents the completion of receipt of a video line and deassertion indicates the beginning of the next video line. Vertical sync signals are asserted for the duration of a video frame. The assertion of a vertical sync signal represents the start of a video frame while the deassertion of the signal indicates the completion of receipt of a frame.

Horizontal and vertical sync signals extracted by stripper 20 are input to system controller 40 and skip line circuit 70. Skip line circuit 70 disables controller 40 from searching a video frame for an indicator signal until a predetermined number of video lines have been received after the start of that frame as indicated by the assertion of a vertical sync signal. Skip line circuit 70 accommodates the use of a portion of each video frame for a purpose other than the production of the video image of the area scanned by sensor 10. One such purpose is the production of alphanumeric characters in the upper portion of the user monitored screen representing information of interest to the weapon user. The image of the area scanned is then produced on the lower portion of the screen.

Each white pulse extracted by stripper 20 is input to controller 40 and to pulse length check circuit 30. Pulse length check circuit 30 effectively measures the duration of each white pulse received and produces a pulse found signal in response to receipt of each white pulse having a duration falling within the predetermined range of durations established for white pulses imposed on the video signal to constitute an indicator found signal. Pulse found signals produced by pulse length check circuit 30 are input to controller 40. Controller 40 then increments a counter in finder circuit 50 when at least one pulse found signal is produced by pulse length check circuit 30 between the receipt of consecutive horizontal sync signals. When incremented a predetermined number of times without being cleared finder circuit 50 produces a trigger signal which is communicated back to system controller 40 indicating the existence of a valid indicator signal in the video frame. The counter in finder circuit 50 is cleared after each video frame and after each video line in which no pulse is found to exist satisfying the brightness and duration criteria established for pulses which constitute a sensor imposed indicator signal.

Clock 80 provides timing signals to controller 40 and as well provides a pulse train of a predetermined frequency to pulse length clock circuit 30. The pulse train is utilized by pulse length check circuit 30 in determining the duration of white pulses received from stripper 20. Reset circuit 90 initializes controller 40 whenever apparatus 15 is initially powered up or whenever the system user closes a switch after determining that reinitialization of the system is necessary. Controller 40 provides an indicator found signal to output circuit 60 in response to receipt of a trigger signal from finder circuit 50. Output circuit 60 amplifies and effectively smooths the transition of each indicator found signal as received from controller 40. The signals produced by output circuit 60 are then utilized in alerting the weapon user to the existence of phenomena to which the weapon is designed to be responsive.

Figure 2:
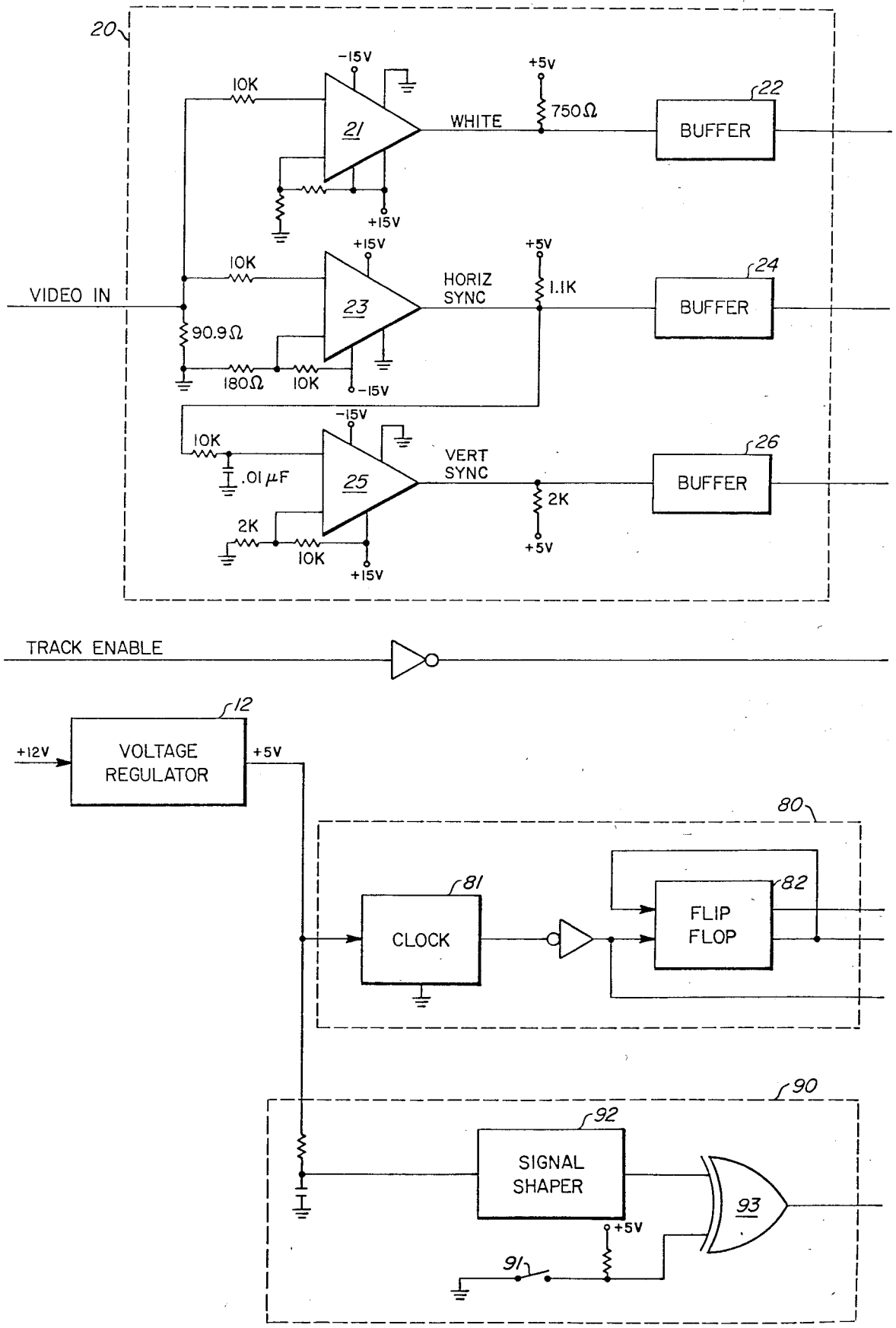
FIG. 2 (3 sheets) is a more detailed schematic diagram of monitoring apparatus components demonstrating apparatus subcomponents and their interaction.
Figure 3:
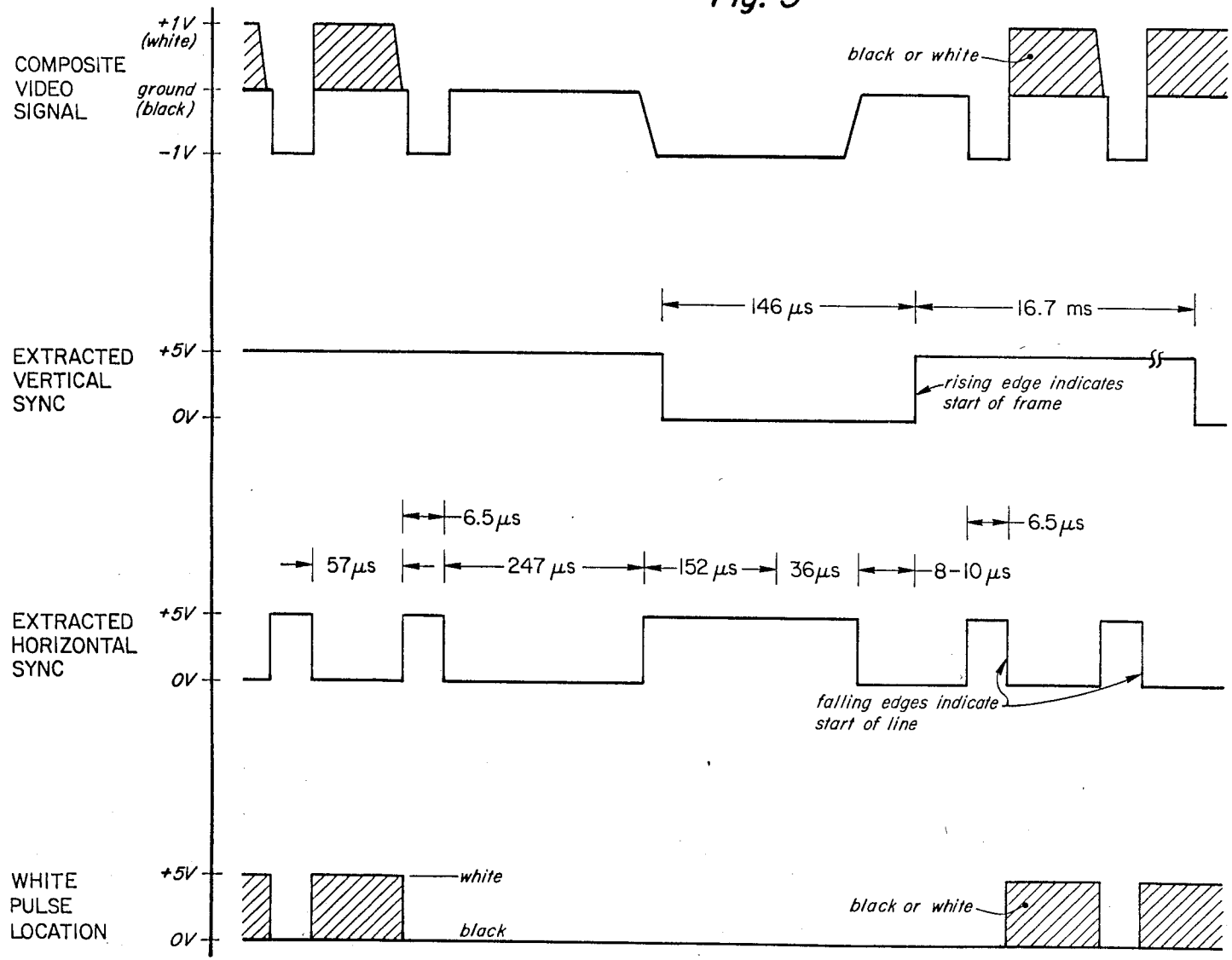
FIG. 3 demonstrates graphically a typical video signal, components thereof and typical timing relationship of signal components.

Referring now to FIG. 2, the components of apparatus 15 are demonstrated in greater detail. The video signal received by stripper circuit 20 is input to level detectors 21 and 23 which, like level detector 25, are operational amplifiers utilized as comparators to operate on and separate predetermined video signal components from the video signal received from sensor 10. Level detector 21 operates on the received signal to extract white pulses in the signal having a brightness level greater than a predetermined minimum brightness level. Level detector 23 extracts horizontal sync signals from the video signal while level detector 25, which has the output of level detector 23 as an input, extracts vertical sync signals from the signal output by level detector 23. A typical composite video signal, its components and their timing relationship is demonstrated in FIG. 3.

Each white pulse extracted from the video signal by level detector 21 is communicated to pulse length check circuit 30 and system controller 40 after passing through output buffer 22. Each horizontal sync signal extracted by level detector 23 is output from stripper 20 to skip line circuit 70 and controller 40 after passing through buffer 24. Similarly, each vertical sync signal extracted by level detector 25 passes through output buffer 26 before being output from stripper 20 to skip line circuit 70 and controller 40. The horizontal and vertical sync signals produced by stripper 20 are input to video line counter 71 of skip line circuit 70. The assertion of each vertical sync signal causes counter 71 to be cleared while the assertion of each horizontal sync signal causes counter 71 to be incremented. The count of counter 71 is communicated to comparator 72 which produces a skip line signal until counter 71 has been incremented a predetermined number of times subsequent to being cleared by the assertion of a vertical sync signal. Skip line signals produced by comparator 72 are input to multiplexer 41 of controller 40 which acts as an input selector for controller 40. Until such time as a skip line signal is no longer asserted by skip line circuit 70 or received by multiplexer 41 during the course of a video frame controller 40 is disabled from producing a signal to increment counter 51 in finder circuit 50 and is thus incapable of producing an indicator found signal.

White pulses extracted from the video signal by level detector 21 are input to counter 31 of pulse length check circuit 30. Counter 31 additionally receives a pulse train produced by system clock 80 which includes pulse producing clock 81. Pulse producing clock 81 receives operational power from the munition system carrying platform through voltage regulator 12. The pulse train produced by clock 81 is of a predetermined frequency, such as 5 MHz, and is input to flip-flop 82 of system clock 80 as well as to counter 31 of pulse length check circuit 30. Flip-flop 82 provides timing signals at the same frequency but of opposite polarity to components of system controller 40 to facilitate the operation of controller 40 and the time1y production of system control signals.

Counter 31 is enabled to count upon concurrent receipt of the pulse train produced by pulse producing clock 81 and a white pulse extracted from the video signal by level detector 21 of stripper 20. Counter 31 counts at a frequency determined by the frequency of the clock produced pulse train. Thus if pulse producing clock 81 produces pulses at 5 MHz, counter 31 will be incremented every 200 nanoseconds during which a white pulse is received from stripper circuit 20. Counter 31 is disabled from counting when receipt of an extracted white pulse is completed. Thus, the count on counter 31 after a counting period represents the duration of the white pulse which enabled it to count within 200 nanoseconds. The count on counter 31, which constitutes duration signalling means, is communicated to memory 32 and is a duration indicative signal which acts to address a particular memory location within memory 32.

When addressed at any one of a number of predetermined memory locations memory 32, which may be a read-only memory, outputs a pulse qualified signal indicating that a white pulse, satisfying both brightness and duration criteria established for imposed indicator signals, has been detected in a video line of the video signal. Memory 32 can be made responsive to any number of counter outputs providing the ability to regulate the sensitivity of pulse length check circuit 30. The signal output by memory 32 in response to being addressed at one of the predetermined locations is a logic ONE signal indicative of the receipt of a qualified white pulse, that is, a white pulse satisfying the duration and brightness criteria for indicator pulses. Output of a logic ONE by memory 32 triggers flip-flop 33 to produce a logic ONE pulse found signal which will remain in production, irrespective of a change in the output of memory 32, until cleared. Memory 32 and flip-flop 33 thus constitute means for producing a pulse found signal. The logic ONE produced by flip-flop 33 is input to flip-flop 34 which transmits the pulse found logic ONE signal to NOR gate 35. NOR gate 35 inverts the logic ONE pulse found signal and transmits the pulse found signal as a logic ZERO to system controller 40 for further use as later described.

System controller 40 produces timing signals for the control of apparatus 15. Among the control signals produced are three reset signals. One of the three reset signals, denominated third reset, is a signal produced by system controller 40 for the purpose of clearing flip-flops 33 and 34 of pulse length check circuit 30. The third reset signal is produced after each video line is received as indicated by the receipt, by system controller 40, of consecutive horizontal sync signals from stripper circuit 20. In that flip-flops 33 and 34 are cleared by a signal produced after the completion of receipt of a video line, pulse length check circuit 30 will produce only one pulse found signal per video line irrespective of the existence of more than one qualified pulse in a line.

Each white pulse received by pulse length check circuit 30 is routed directly to counter 31 enabling it to count as earlier noted. Additionally, each white pulse is routed through a series of inverters which delay the signal allowing it to be utilized to clear counter 31. Each white pulse is utilized additionally, after passing through an inverter, as a signal to clock pulse found signals out of flip-flop 33 when such signals are produced by ROM 32.

In response to receipt of a pulse found signal from pulse length check circuit 30, system controller 40 produces, as one of the apparatus control signals, an increment signal which is communicated to finder circuit 50. Counter 51 of finder circuit 50 is incremented each time an increment signal is received. After being incremented a predetermined number of times without being cleared counter 51 produces a trigger signal. The number of times counter 51 must be incremented without being cleared in order to produce a trigger signal is predetermined by the number of consecutive lines in which white pulses are imposed on the video signal to constitute a valid indicator signal. Trigger signals asserted by counter 51 are logic ONE signals which are input to flip-flop 52. Flip-flop 52 communicates the trigger signal as a logic ONE to multiplexer 41 of system controller 40 and to gate 53 within finder circuit 50.

Gate 53 of finder circuit 50 functions as a logic NOR gate which, in conjunction with gates 54 and 55, make up a logic network the purpose of which is to clear counter 51 and flip-flop 52 after the occurrence of any one of three predetermined events. Gate 53 has as inputs the signal output by flip-flop 52 and one of the three reset signals produced by system controller 40. The reset signal input to gate 53 is denominated first reset and is asserted by system controller 40 as a logic ZERO. The first reset signal is produced by system controller 40 upon the receipt of consecutive horizontal sync signals from stripper circuit 20, between the receipt of which no pulse found signal is received from pulse length check circuit 30. This indicates the receipt of a video line lacking a qualified indicator pulse.

When flip-flop 52 produces a logic ONE trigger signal gate 53 is disabled from producing a logic ONE and is thus disabled from producing a signal which, in conjunction with NOR gate 55, would clear counter 51. In this manner a trigger signal, once produced, remains in production until the completion of receipt of the video frame which produced it irrespective of the subsequent production of first reset signals by system controller 40 which will produce a first reset signal for each video line in a video frame subsequent to the consecutive video lines in which the indicator signal is located. Controller 40 does not search for the existence of a trigger signal input from finder circuit 50 until the completion of each video frame necessitating the above-described configuration.

Exclusive OR gate 54 receives as inputs the second reset signal produced by system controller 40 and indicator found signals when asserted by controller 40 in response to receipt of a trigger signal from finder circuit 50. The second reset signal is produced by controller 40 after receipt of a video frame which lacks an imposed indicator pulse as indicated by the failure of finder circuit 50 to produce a trigger signal during the course of receipt of a video frame. Thus, upon completion of each video frame controller 40 will produce either an indicator found signal or a second reset signal.

During the receipt of a video frame each of the inputs to gate 54 will have the same logic signal characteristics and the output of gate 54 will be a logic ZERO. When either an indicator found or second reset signal is asserted at the completion of a video frame the respective input to gate 54 will change state causing gate 54 to produce a logic ONE signal which is processed through gate 55 to clear counter 51 and flip-flop 52. In sum, gate 54 will output a logic ONE after each video frame and gate 53 will output a logic ONE after each video line in which no indicator pulse exists. The output of a logic ONE by ether of gates 53 or 54 causes counter 51 and flip-flop 52 to be cleared and gates 53, 54 and 55 can be seen to comprise means for clearing counter 51.

Apparatus 15 includes power reset circuit 90 which initializes system controller 40 whenever power is initially received from voltage regulator 12 or whenever switch 91 is closed by the apparatus user. When power is initially received from voltage regulator 12 it is received as an analog voltage which must be processed prior to input to gate 93. For this purpose signal shaper 92, which consists of a series of inverters, exists in reset circuit 90. The signal produced by signal shaper 92 will be either a logic ONE or ZERO. Both at power up and when switch 91 is closed exclusive OR gate 93 will produce a reset signal. The reset signal, which initializes controller 40 by setting microcontroller 45 to its initial state, is asserted by gate 93 as a logic ZERO. After initial power up and while switch 91 remains open gate 93 produces a logic ONE. The signal produced by gate 93 is inverted prior to input to microcontroller 45.

The system operator, in addition to having available switch 91 for reinitializing controller 40, has available a switch external to apparatus 15 by which apparatus 15 can be disabled from operating. The state of the input to multiplexer 41 on the track enable line is determined by the position of this switch. In this embodiment, when controller 40 receives a logic ONE as in input on the track enable line it is enabled to function. Receipt of a logic ZERO indicates the desire of the system user that apparatus 15 not function and disables controller 40 from performing its search for an imposed indicator signal.

At the output end of apparatus 15 flip-flop 61 of output circuit 60 receives indicator found signals and second reset signals when produced by system controller 40. Receipt of an indicator found signal triggers flip-flop 61 to produce a logic ONE which is input to hysteresis circuit 62. Hysteresis circuit 62 is a one-shot multivibrator which smooths the output of flip-flop 61 enabling it to last over several frames of the video signal. The signal produced by output circuit 60 can be utilized in a number of ways, such as to produce an audio signal, to alert the system user to the existence of an indicator found signal. Production of a second reset signal by controller 40 resets flip-flop 61 causing its output to become a logic ZERO if it had previously been a logic ONE. Output circuit 60 is thus caused to discontinue producing an indicator found output signal by receipt of the next video frame in which no indicator signal is imposed.

System controller 40 includes commonly available components which interact to provide timed control signals to facilitate the operation of apparatus 15. The embodiment herein described is one which has proven convenient although innumerable other system controller configurations can be envisioned.

Multiplexer 41, which may be a National Semiconductor model 74251 component, functions as an input selector which outputs only one of the signals input to it at any given time as a function of selector signals received from ROM 46. Exclusive OR gate 42 is utilized as a programmable inverter which selectively inverts the signal output by multiplexer 41 for compatibility with and further use by opcode ROM 44. Opcode ROM 44, like ROMs 46 and 47 may be model 7603 memories produced by Harris Corporation. Opcode ROM 44 provides operating instructions to microcontroller 45 based upon the memory location at which ROM 44 is addressed. ROM 44 is addressed by a combination of the signal produced by gate 42 as clocked into ROM 44 by flip-flop 43 and a signal output by ROM 47. The signals output by ROM 47 are a function of the current state of microcontroller 45. The current state of microcontroller 45 is also communicated to next state ROM 46 which provides microcontroller 45 signals determinative of the next state to which microcontroller 45 can proceed. Microcontroller 45 may be a model 74482 component produced by Texas Instruments Corporation. Next state ROM 46 additionally utilizes current state information produced by microcontroller 45 to determine which of the signals input to multiplexer 41 is to be output to gate 42 as well as whether the signal as output by gate 42 is inverted.

Microcontroller 45 of system controller 40 is initialized at power up or whenever switch 91 of reset circuit 90 is closed. Both the closing of switch 91 and initial receipt of power via voltage regulator 12 set microcontroller 45 to its initial state and provide a starting point for system controller operation.

ROM 47, in addition to producing signals determinative of the operating instruction produced by ROM 44, produces the signals which control the operation of monitoring apparatus 15 and its subcircuits as a function of microcontroller state. The control signals produced by ROM 47 are communicated to output register 48 and are clocked out of register 48 upon receipt of timing signals from flip-flop 82 of system clock 80. The operation of system controller 40 can be implemented by persons skilled in the electronics arts having access to readily available component manufacturer's documentation in accordance with the following basic definition of controller operation and the microcontroller state associated with each operation.

Figure 4:
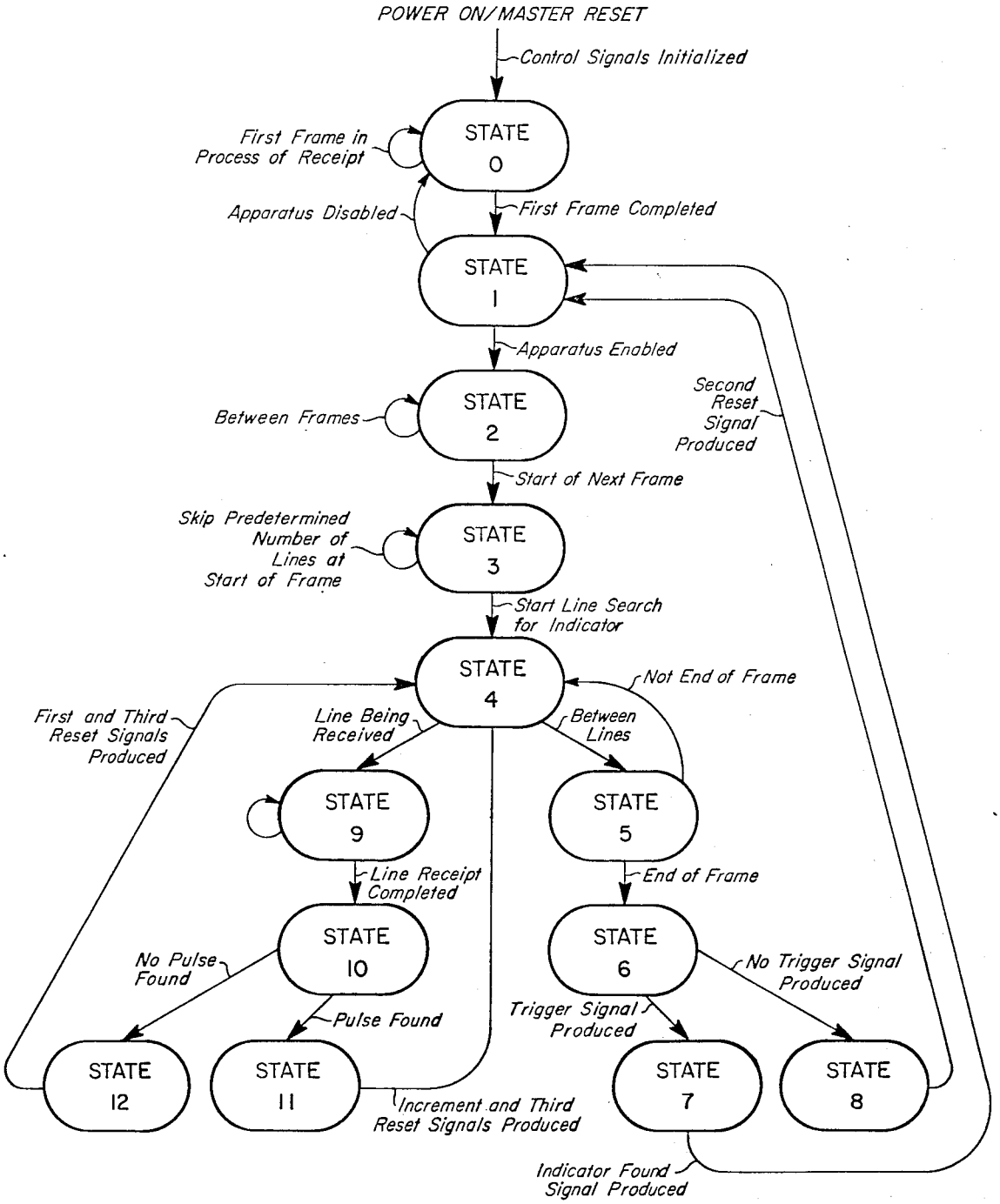
FIG. 4 is a state diagram which facilitates an understanding of the operation of the system controller.

Referring now to FIGS. 2 and 4, it is seen that at power up or whenever switch 91 of reset circuit 90 is closed microcontroller 45 is set to state ZERO, its initial state. The state of microcontroller 45 is continually communicated to ROMs 46 and 47. In state ZERO output ROM 47 produces initial system control signals and provides the signals to output register 48 from which they are clocked to various apparatus components upon receipt of a timing signal from system clock 80. The control signals initially produced by ROM 47 are the second and third reset signals which clear flip-flops 34 and 61. Additionally, the increment, first reset and indicator found signals are deasserted if asserted when system initialization occurs.

System controller 40 enters state ONE at the completion of the first video frame received. In state ONE controller 40 monitors the track enable input to multiplexer 41 to determine whether or not the system user desires monitoring apparatus 15 to function. If the track enable input is set to allow apparatus 15 to function system controller 40 moves to state TWO. If the track enable input indicates that apparatus 15 is not to function controller 40 returns to state ZERO and the search for an enabling track enable input will recur for each frame until found.

In state TWO controller 40 awaits the beginning of the next occurring video frame as indicated by the change in state of the vertical sync signal received from stripper circuit 20. Upon assertion of the next occurring vertical sync signal system controller 40 moves to state THREE. In state THREE controller 40 awaits the deassertion of the skip line signal from skip line circuit 70 indicating the receipt of a predetermined number of video lines by apparatus 15 subsequent to the assertion or start of a video frame. Upon deassertion of the skip line signal controller 40 moves to state FOUR.

Upon reaching state FOUR controller 40 examines the horizontal sync signal input to multiplexer 41. If no horizontal sync signal is in the process of being asserted, indicating that the receipt of a video line is in progress, controller 40 moves to state NINE. Upon completion of a video line, as indicated by the assertion of the next occurring horizontal sync signal, controller 40 moves to state TEN. In state TEN the pulse found input to multiplexer 41 is examined. If a pulse found signal has been asserted, indicating the existence of a qualified white pulse in the just completed video line controller 40 moves to state ELEVEN.

In state ELEVEN controller 40 produces the increment control signal which is communicated to counter 51 of finder circuit 50. If no pulse found signal is received at multiplexer 41 after the completion of a video line controller 40 moves from state TEN to state TWELVE. In state TWELVE controller 40 produces the first reset control signal which is input to gate 53 and which will cause counter 51 to be reset and flip-flop 52 to be cleared if no trigger signal has as yet been produced by finder circuit 50 during the course of the frame. Controller 40 produces the third reset control signal to clear flip-flops 33 and 34 in both states ELEVEN and TWELVE with the result that flip-flops 33 and 34 are cleared after each video line irrespective of the production or nonproduction of a pulse found signal.

From states ELEVEN and TWELVE controller 40 returns to state FOUR. Controller 40 steps through states TEN and ELEVEN or TEN and TWELVE, returns to state FOUR and proceeds to state FIVE all during the course of receipt of one horizontal sync signal, that is, between the receipt of each pair of consecutive video lines. Upon returning to state FOUR and while the horizontal sync signal remains asserted between the receipt of consecutive video lines controller 40 repetitively jumps between states FOUR and FIVE unless the vertical sync signal, which remains asserted during the course of receipt of a video frame, is deasserted during the receipt of that particular horizontal sync signal indicating the completion of a video frame. Completion of a video frame, as indicated by the deassertion or completion of receipt of a vertical sync signal occurs while a horizontal sync signal is asserted in all cases. When a frame ends and the vertical sync signal is deasserted controller 40 moves from state FIVE to state SIX. In state SIX the trigger signal input to multiplexer 41 is examined. If a trigger signal has been produced during the course of the previous frame controller 40 moves to state SEVEN. In state SEVEN controller 40 produces the indicator found signal which is communicated to output circut 60 and gate 54 of finder circuit 50. If no trigger signal has been produced during the course of the video frame controller 40 moves from state SIX to state EIGHT. In state EIGHT controller 40 produces the second reset signal which, like the indicator found signal is communicated to finder circuit 50 and output circuit 60. Controller 40 returns to state ONE from both states SEVEN and EIGHT.

What is claimed is:

1. Apparatus for monitoring a video signal in a line by line, frame by frame sequence for the existence of an indicator signal where said video signal includes vertical sync signals indicative of the start of each video frame and horizontal sync signals indicative of the start of each video line in a video frame and where said indicator signal is a plurality of qualified white pulses imposed one pulse per video line in a predetermined number of consecutive video lines in a video frame, said qualified white pulses being pulses both exceeding a predetermined brightness level and having a duration falling within a predetermined range of durations, said monitoring apparatus comprising:

video signal stripper means having said video signal as an input, for extracting said vertical sync signals, said horizontal sync signals and white pulses from said video signal, said extracted white pulses being white pulses in said video signal having a brightness level exceeding said predetermined brightness level established for said qualified white pulses;

pulse length checking means receiving said extracted white pulses as an input, for determining the duration of each extracted white pulse received and producing a pulse found signal in response to receipt of an extracted white pulse having a duration falling within said predetermined range of durations established for said qualified white pulses;

indicator finding means incremented in response to production of a pulse found signal by said pulse length checking means, for producing a trigger signal, said indicator finding means producing said trigger signal in response to being incremented a predetermined number of times prior to being cleared, said predetermined number of times said finding means is required to be incremented to produce said trigger signal being equal to said predetermined number of consecutive video lines in which said qualified white pulses must exist to constitute a valid indicator signal; and a system controller electrically connected to said stripper means, said pulse length checking means and said indicator finding means, said controller producing a plurality of system control signals, said control signals including an indicator found signal, said indicator found signal produced by said controller in response to production of a trigger signal by said indicator finding means indicating receipt by said monitoring apparatus of a video frame containing a valid indicator signal.

2. The monitoring apparatus according to claim 1 wherein said pulse length checking means comprises:

duration signalling means, receiving said extracted white pulses as an input, for producing a signal indicative of the duration of each of said extracted white pulses received; and means for producing said pulse found signal, having said duration indicative signals as an input, said pulse found signal produced in response to receipt of a selected portion of said duration indicative signals, said selected portion of duration indicative signals being signals produced by said duration signalling means in response to receipt of extracted white pulses having a duration falling within said predetermined range of durations established for said qualified white pulses.

3. The video signal monitoring apparatus according to claim 2 further comprising a system clock, said clock producing clock signals for input to said system controller and a pulse train, said pulse train being produced at a predetermined frequency, wherein said duration signalling means of said pulse length checking means is a counter having said pulse train as an input, said counter enabled to count for a counting period by the concurrent receipt of an extracted white pulse and said pulse train and at a rate predetermined by said pulse train frequency, the count of said counter after completion of a counting period being output by said counter as said duration indicative signal.

4. The monitoring apparatus according to claim 3 wherein said system controller receives as inputs said extracted horizontal and vertical sync signals and said extracted white pulses from said stripper means, wherein said plurality of control signals include a signal for incrementing said indicator finding means in response to production of a pulse found signal by said pulse length checking means, a first reset signal for clearing said indicator finding means and a second reset signal for clearing said indicator finding means, said first reset signal produced in response to receipt by said monitoring apparatus of a video line lacking a qualified white pulse and said second reset signal produced in response to receipt by said monitoring apparatus of a video frame lacking an indicator signal, and wherein said indicator finding means comprises:

a clearable counter having said control signal for incrementing said indicator finding means produced by said system controller as an input, said counter producing said trigger signal in response to being incremented said predetermined number of times prior to being cleared; and means for clearing said counter receiving as inputs said first reset signal, said second reset signal and said indicator found signal when produced by said controller, said counter clearing means producing a counter clearing signal in response to receipt to any one of said input signals.

5. The monitoring apparatus according to claim 4 wherein said plurality of control signals produced by said system controller includes a third reset signal, said third reset signal produced by said system controller after receipt by said monitoring apparatus of each video line in said video signal and wherein said means for producing said pulse found signal in said pulse length checking means comprises:

addressable memory, each duration indicative signal produced by said counter in said pulse length checking means addressing a location in said memory, said memory producing a pulse qualified signal in response to receipt of said selected portion of duration indicative signals, said selected portion of duration indicative signals being signals which address said memory at predetermined memory locations; and a flip-flop, said flip-flop electrically connected to said memory and producing said pulse found signal in response to receipt of a pulse qualified signal from said memory.

6. The monitoring apparatus according to claim 5 further comprising skip line means having said horizontal and vertical sync signals extracted by said stripper means as an input, for disabling said system controller from producing said signal for incrementing said counter in said indicator finding means prior to receipt by said monitoring apparatus of a predetermined number of video lines subsequent to the beginning of each video frame received.

7. The video signal monitoring apparatus according to claim 6 wherein said skip line means comprises:

a horizontal pulse counter having said extracted horizontal and vertical sync signals as inputs, said counter incremented by receipt of a horizontal sync signal and cleared by receipt of a vertical sync signal, said counter producing a count signal indicative of the number of video lines received subsequent to the start of a video frame; and a comparator having said count signal produced by said horizontal pulse counter as an input, said comparator producing a skip line signal disabling said controller from producing said signal for incrementing said counter in said indicator finding means, said skip line signal produced by said comparator whenever the count of said horizontal pulse counter is less than a predetermined count.

* * * * *